US006212740B1

(12) United States Patent
Yang et al.

(10) Patent No.: US 6,212,740 B1
(45) Date of Patent: Apr. 10, 2001

(54) FASTENING DEVICE FOR SAFETY BELT

(76) Inventors: Wu-Zhi Yang, No. 180, Sec. 1, Chien Kuo North Rd., 23 Lin,Si Chuan Li, South District, Taichung City (TW); Bor-Sheng Hwang, No. 74, Go Nei Rd., 7 Lin, Go Nei Village, Hsien Si Hsiang, Changhua Hsien (TW); Sen-Jung Lai, No. 5, Lane 48, Chun Kung Rd., 11 Lin, Chun Kung Li, Pei Tun District, Taichung City (TW)

( * ) Notice: Subject to any disclaimer, the term of this patent is extended or adjusted under 35 U.S.C. 154(b) by 0 days.

(21) Appl. No.: 09/033,415

(22) Filed: Mar. 2, 1998

(51) Int. Cl.[7] ..... A44B 11/06
(52) U.S. Cl. ..... 24/170; 24/193
(58) Field of Search ..... 24/170, 193, 197, 24/191, 163 R, 115 H

(56) References Cited

U.S. PATENT DOCUMENTS 553,703 * 1/1896 Cavanagh ..... 24/191
764,065 * 7/1904 Mitchell ..... 24/193
1,436,880 * 11/1922 Keller ..... 24/191
2,012,835 * 8/1935 Stark ..... 24/191

* cited by examiner

*Primary Examiner*—James R. Brittain
(74) *Attorney, Agent, or Firm*—Browdy and Neimark

(57) ABSTRACT

A fastening device for safety belt, including a first longer U-shaped biting plate, a second shorter U-shaped biting plate and an insertion pin. The first and second biting plate are formed with opposite ratchets on inner sides. The biting plates are positioned on two sides of a lower U-shaped suspending section of the safety belt and fitted with each other. The bent sections of the first biting plate cover the bent sections of the second biting plate in a stacked state. The U-shaped suspending section of the safety belt is clamped between the biting plates with the pin holes thereof aligned with each other. The insertion pin is passed through the pin holes and through the U-shaped suspending section of the safety belt. The ends of the insertion pin are enlarged to assemble with the safety belt by riveting, whereby the biting plates can be quickly slid along the suspending section of the safety belt to adjust the size of the fastening loop.

5 Claims, 7 Drawing Sheets

FASTENING DEVICE FOR SAFETY BELT

BACKGROUND OF THE INVENTION

The present invention relates to a fastening device for a safety belt used in escaping or mountaineering or for seat belt of a car or the like. The fastening device is fitted with the a safety belt to form a fastening loop. The fastening device can be quickly slid along the fastening loop to adjust the size thereof to suit different body dimensions. The fastening device permits a user to quickly fit the fastening loop onto his/her body and can be quickly shifted to tighten the user's body in an emergency. After being fastened and located, the biting plates of the fastening device bite the belt body to prevent the belt body from loosening so as to ensure safety.

FIGS. 1 and 2 show an escaping suspension pulley 10 installed at the porch of a building. The suspension pulley 10 is hung on a safety hook 20 fixed on the wall. Two straps 11 downwardly extend from the suspension pulley 10. The end of each strap is formed as a fastening loop 12 tied with a substantially B-shaped adjustable fastening buckle 30. FIGS. 3 and 4 show two existing types of the fastening buckles, wherein in FIG. 3, the fastening buckle is plane, while in FIG. 4, the fastening buckle is curved. The fastening buckle 30 can be slid along the strap for adjusting the size of the fastening loop 12 for tightening the waist section of a user as shown in FIG. 1. Accordingly, as shown in FIG. 4, the user is suspended and able to slowly move down from the porch for escaping in an emergency.

The above conventional fastening buckles 30 are freely movably fitted with the strap, while lacking a securing force. Therefore, when the fastening loop 12 tightens the waist section as shown in FIG. 1. the fastening buckle 38 tends to slip away to enlarge the fastening loop 12. At this time, in case the user just raises his/her both hands, the user may come loose from the fastening loop 12 to drop down.

SUMMARY OF THE INVENTION

It is therefore a primary object of the present invention to provide a fastening device for a safety belt. The fastening device is fitted with the safety belt to form a fastening loop. The fastening device can be quickly slid along the fastening loop to adjust the size thereof to suit different body dimensions. The fastening device permits a user to quickly fit the fastening loop onto his/her body and can be quickly shifted to tighten the user's body in an emergency.

It is a further object of the present invention to provide the above fastening device in which after the biting plates of the fastening device are fastened and located, the biting plates bite the belt body to prevent the belt body from loosening so as to ensure safety, The present invention can be best understood through the following description and accompanying drawings, wherein:

DETAILED DESCRIPTION OF THE PREFERRED EMBODIMENTS

Figure 1:
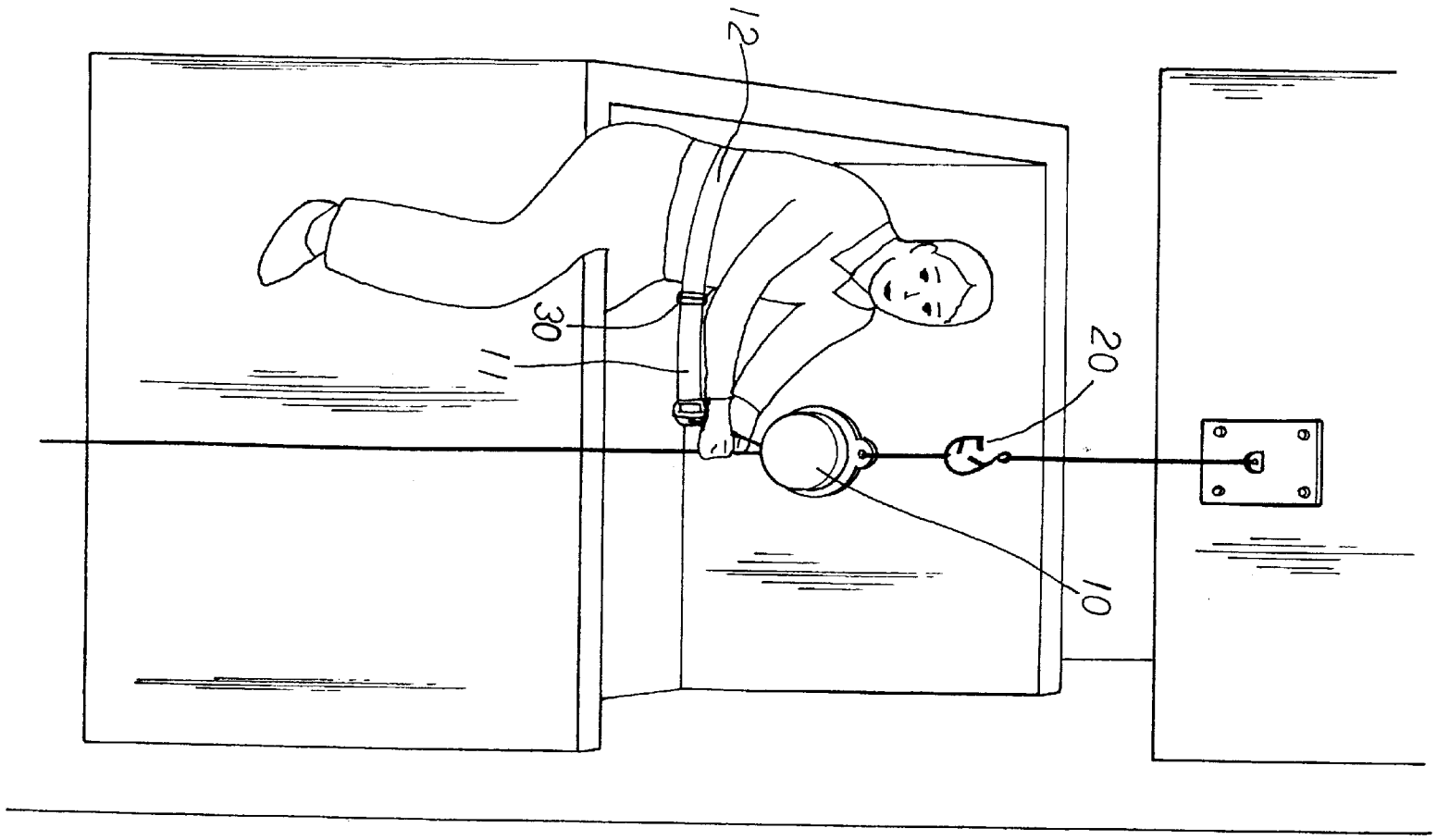
FIG. 1 PRIOR ART
FIG. 1 shows a conventional escaping suspension pulley installed at a porch of a building.
Figure 2:
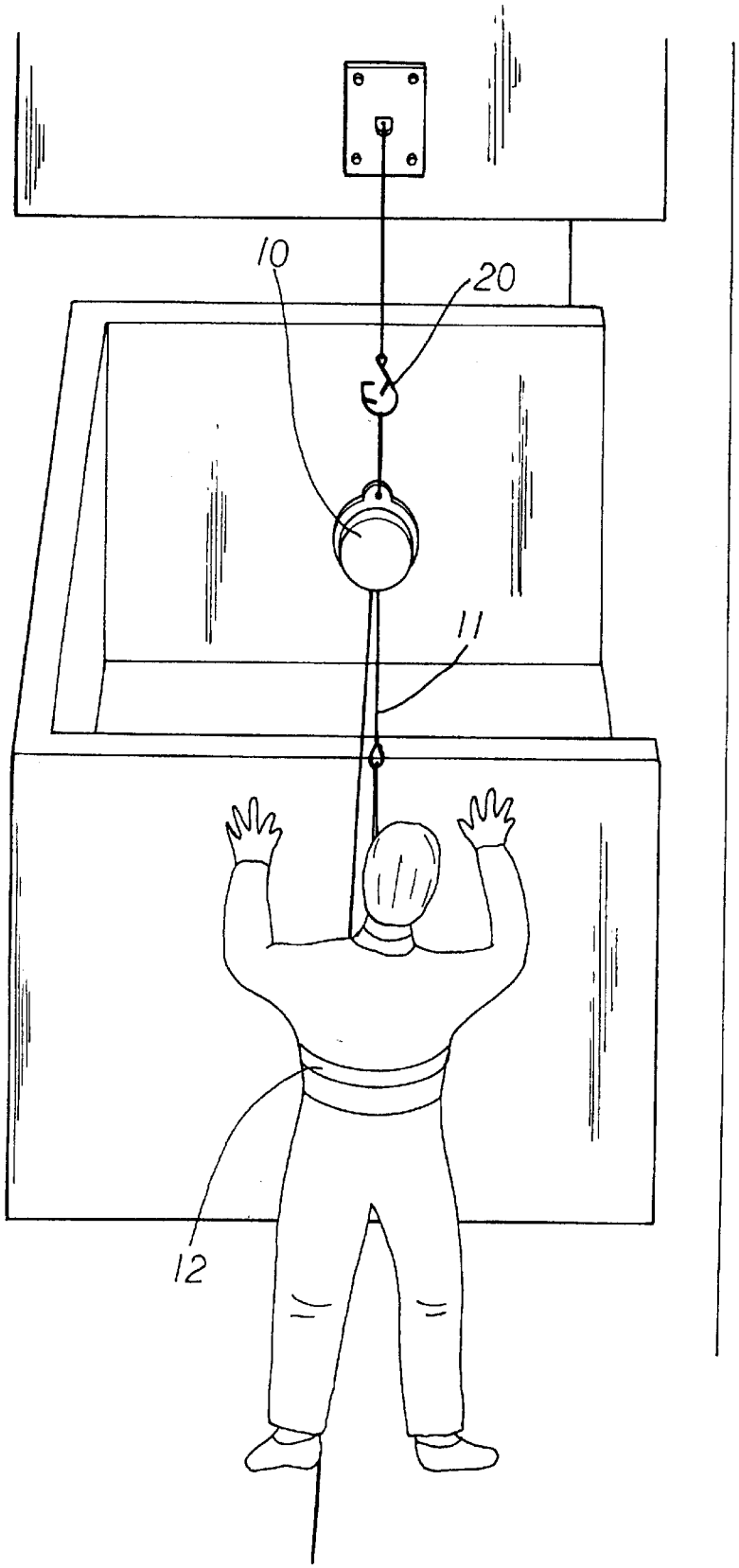
FIG. 2 PRIOR ART
FIG. 2 shows the usage of the escaping suspension pulley of FIG. 1.
Figure 3:
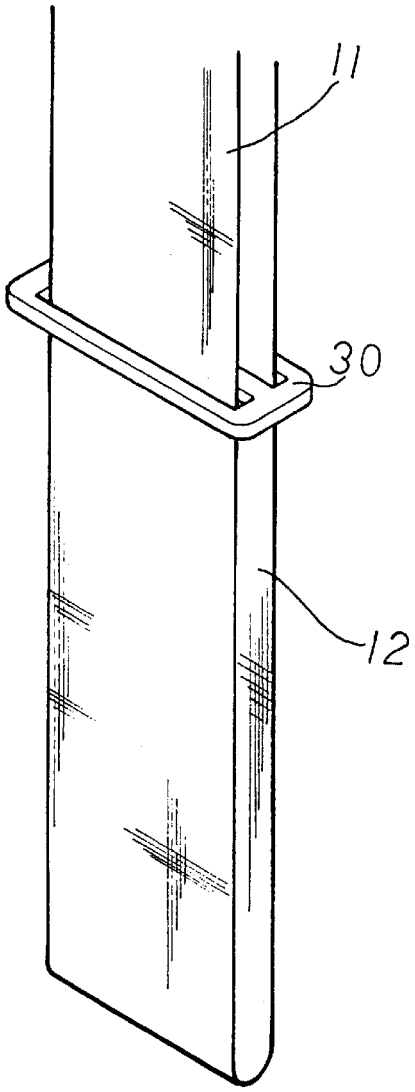
FIG. 3 PRIOR ART
FIG. 3 shows a conventional plane adjusting fastening buckle of the safety belt.
Figure 4:
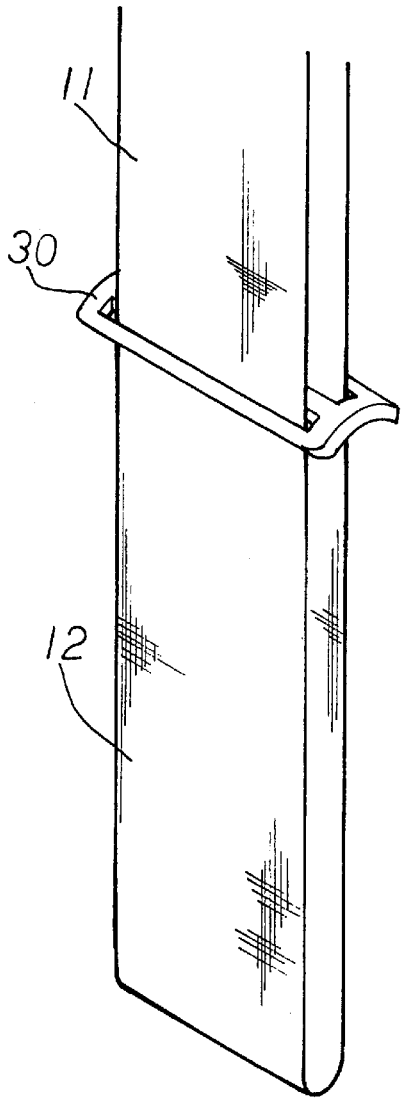
FIG. 4 PRIOR ART
FIG. 4 shows a conventional curved adjusting fastening buckle of the safety belt.
Figure 6:
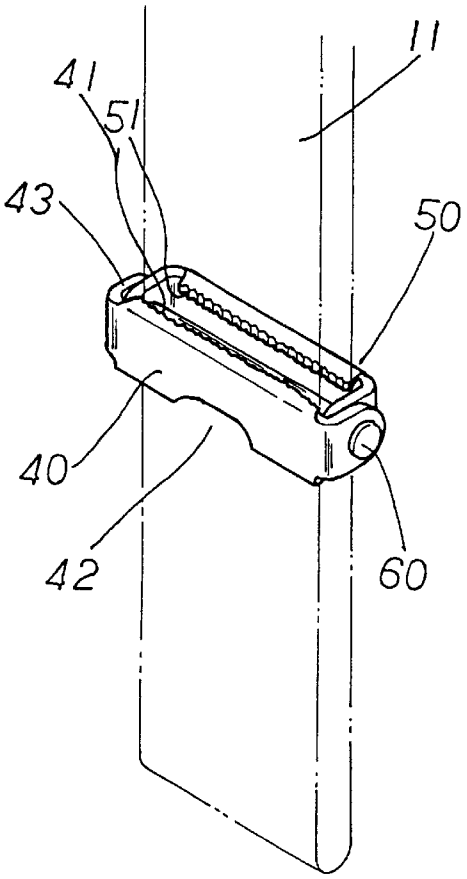
FIG. 6 is a perspective assembled view of the present invention.
Figure 5:
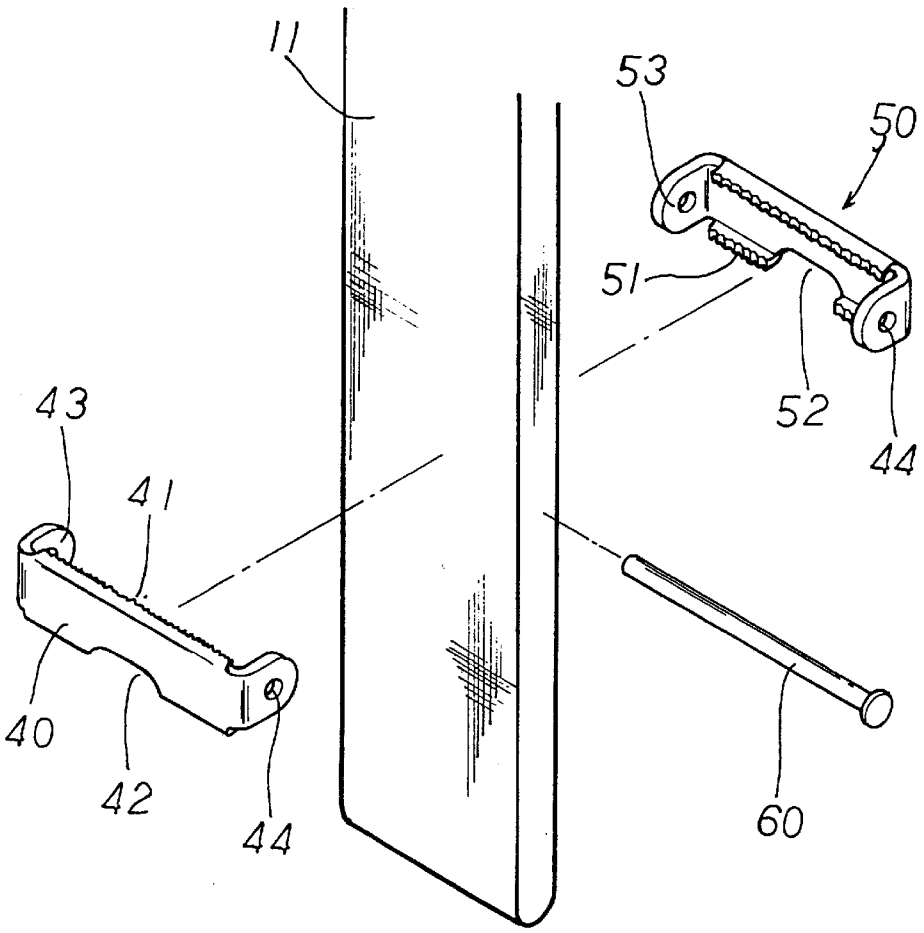
FIG. 5 is a perspective exploded view of the present invention.
Figure 7:
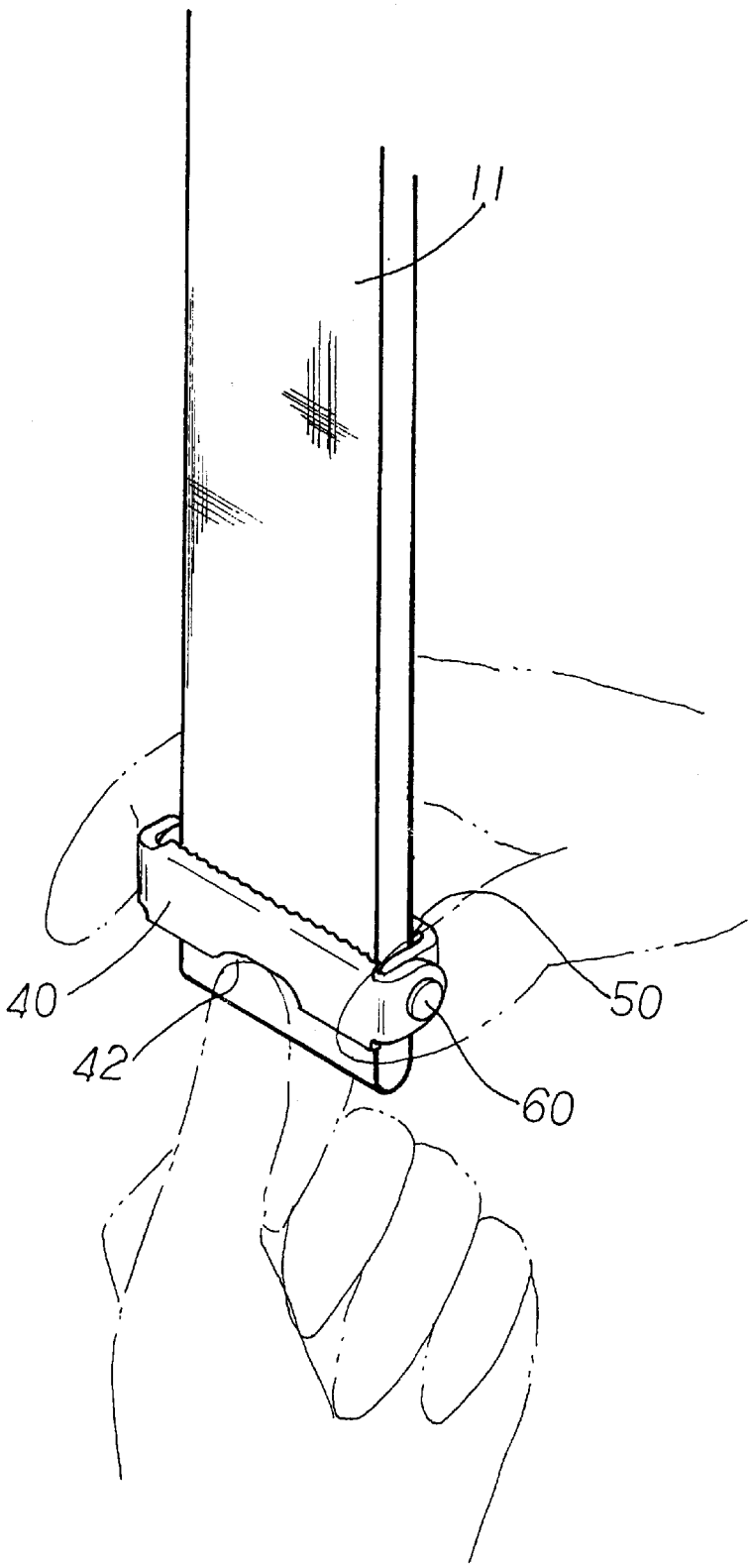
FIG. 7 shows the usage of the present invention.

Please refer to FIG. 5. The present invention includes a first longer U-shaped biting plate 48, a second shorter U-shaped biting plate 50 and an insertion pin 60. The first biting plate 40 is formed with two rows of ratchets 41 on a inner side. The second biting plate 50 is formed with two rows of ratchets 51 on an inner side opposite to the ratchets 41 of the first biting plate 40. Each of the biting plates 40, 50 is formed with an arch notch 42, 52 at a middle section and two inward bent sections 43, 44, 53, 54 at two ends. Each inward bent section is formed with a pin hole. Referring to FIGS. 6 and 7, the biting plates 40, 50 are positioned on two sides of a lower U-shaped suspending section of the safety belt and fitted with each other. The bent sections 43, 44 of the first biting plate 40 cover the bent sections 53, 54 of the second biting plate 50 in a stacked state. As shown in FIG. 7, the U-shaped suspending section of the safety belt 11 is clamped between the biting plates 40, 50 with the pin holes thereof aligned with each other. Then the insertion pin 60 is passed through the pin holes and through the U-shaped suspending section of the safety belt 11. Then the ends of the insertion pin 60 are enlarged to assemble with the safety belt 11 by riveting. Accordingly, the biting plates 40, 50 can be quickly slid along the suspending section of the safety belt 11 to adjust the size of the fastening loop.

Figure 11:
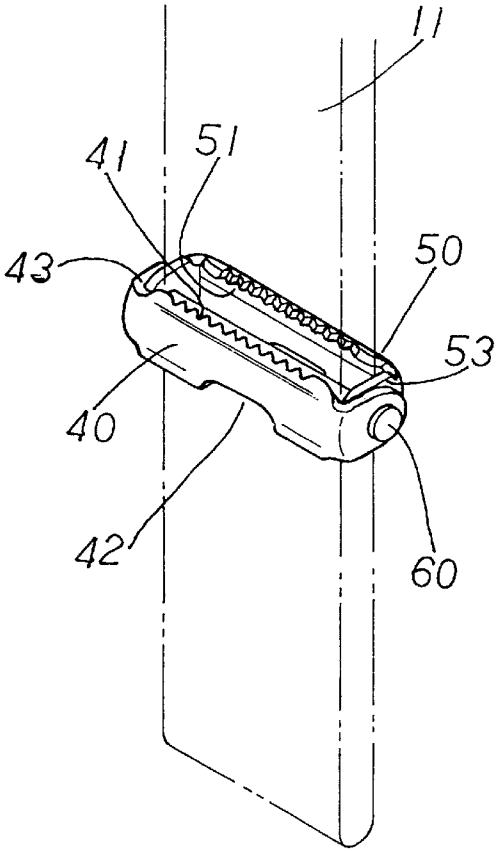
FIG. 11 is a perspective diagram showing the operation mode of the embodiment as shown in FIG. 10.
Figure 10:
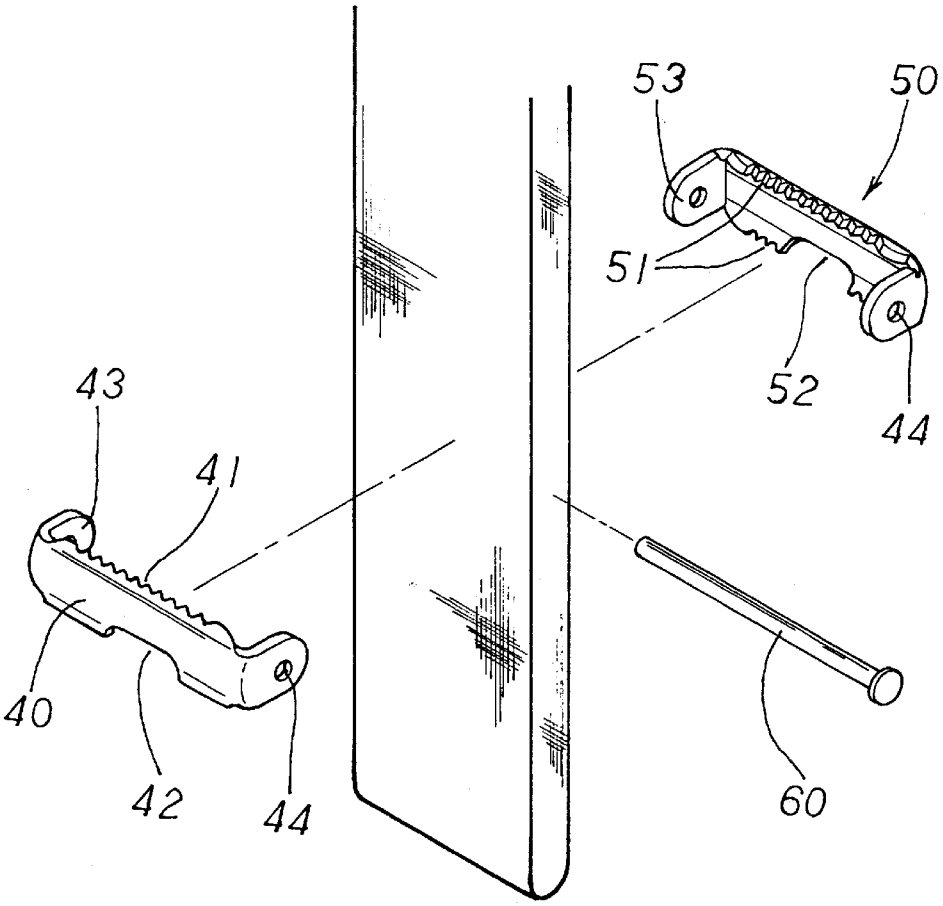
FIG. 10 is a perspective diagram showing the exploded components of another embodiment of the present invention.

Please refer to FIGS. 10, 11, where another embodiment of the present invention is presented wherein the surfaces of the biting plates 40, 50 are made slightly curved and the ratchets 41, 51 are made in a larger size and in a coarser manner so that the biting plates 40, 50 can be in biting engagement with the safety belt 11 in a firmer manner and the control of the safety belt 11 in operation becomes more sensitive.

The ratchets 41, 51 of the biting plates 40, 50 can be sharp ratchets or trapezoid or arch ratchets according to the materials of different safety belts 11 for achieving an optimal biting effect.

Figure 8:
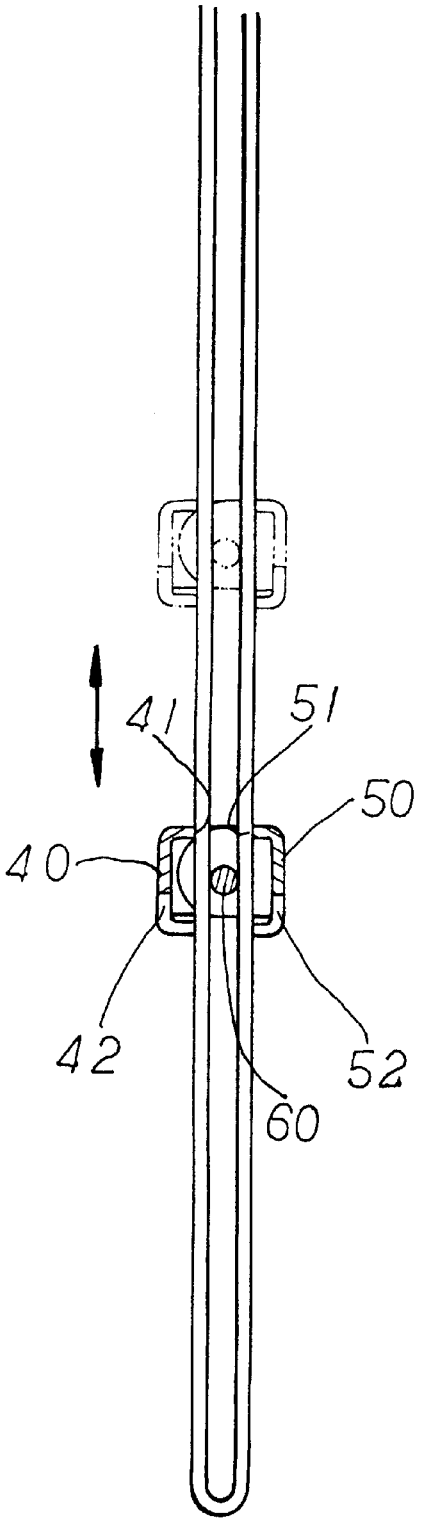
FIG. 8 shows that the fastening device of the present invention is smoothly slid along the safety belt body.
Figure 9:
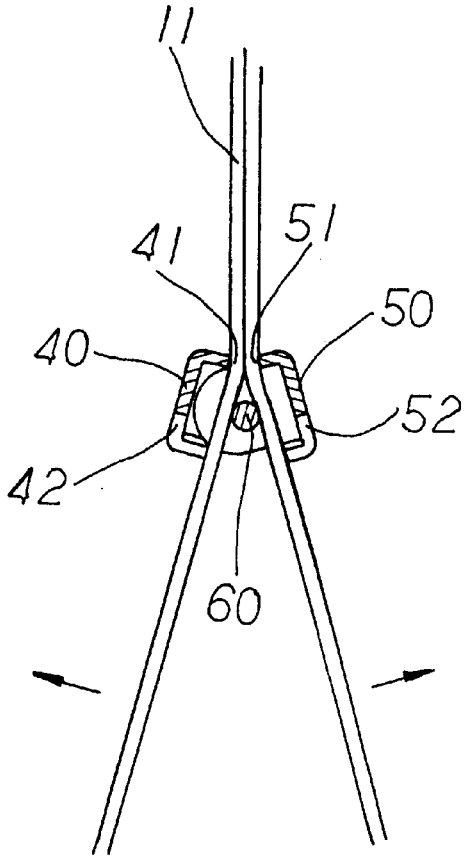
FIG. 9 shows that the biting plates of the fastening device of the present invention bite the safety belt body to ensure safety.

According to the above arrangement, the fastening device of the present invention is applicable to various kinds of safety belts to quickly form an adjustable fastening loop. Referring to FIGS. 8 and 9, the fastening device can be quickly adjustably slid along the safety belt to form different sizes of fastening loops to meet the requirements of different dimensions of the users. The fastening device permits a user to quickly fit the fastening loop onto his/her body and can be quickly shifted to tighten the user's body in an emergency. After the biting plates are fastened and located, the biting plates bite the belt body to prevent the belt body from loosening so as to ensure safety.

The above embodiments are only some examples of the present invention and the scope of the present invention should not be limited to the examples. Any modification or variation derived from the examples should fall within the scope of the present invention.

What is claimed is:

1. A fastening device for engaging a lower U-shaped suspending section of a safety belt; the fastening device comprising:

a longer, first U-shaped biting plate;

a shorter, second U-shaped biting plate; and an insertion pin;

the first biting plate including first ratchets on a first inner side thereof, the second biting plate including two rows of second ratchets on a second inner side opposite to the first ratchets of the first biting plate;

each of the first biting plate and the second biting plate comprising an arch notch at a respective middle section thereof and two inward-bent sections at two respective ends thereof;

each inward-bent section including a pin hole;

the biting plates being positioned on two sides of the lower U-shaped suspending section and fitted to each other;

the bent sections of the first biting plate covering the bent sections of the second biting plate in a stacked configuration;

the U-shaped suspending section of the safety belt being clamped between the first biting plate and the second biting plate with the pin holes thereof aligned with each other;

the insertion pin being passed through the pin holes and through the U-shaped suspending section of the safety belt; and the ends of the insertion pin being enlarged to assemble with the safety belt by riveting;

whereby the biting plates can be quickly slid along the suspending section of the safety belt to adjust the size of the fastening loop.

2. The fastening device according to claim 1, wherein the first biting plate and the second biting plate each include a respective bulged face, and wherein the first ratchets and the second ratchets are large in size and coarse;

whereby the biting plates are in a secure engagement with said safety belt, and whereby control of said safety belt is sensitive.

3. The fastening device according to claim 1, wherein the ratchets of the first biting plate and the second biting plate are s harp;

whereby an optimal biting effect in a safety belt material adapted to sharp ratchets is achieved.

4. The fastening device according to claim 1, wherein the ratchets of the first biting plate and the second biting plate are trapezoidal;

whereby an optimal biting effect in a safety belt material adapted to trapezoidal ratchets is achieved.

5. The fastening device according to claim 1, wherein the ratchets of the first biting plate and the biting plate comprise arch ratchets;

whereby an optimal biting effect in a safety belt material adapted to arch ratchets is achieved.

* * * * *